United States Patent [19]

Russo et al.

[11] Patent Number: 5,045,985

[45] Date of Patent: Sep. 3, 1991

[54] SELF LOCKING ADJUSTABLE MOUNTING BARS

[75] Inventors: Neil Russo, Howell, N.J.; Kingsley Chan, Mission Viejo, Calif.

[73] Assignee: Lightolier, Inc., Secaucus, N.J.

[21] Appl. No.: 493,906

[22] Filed: Mar. 15, 1990

[51] Int. Cl.[5] ..... B42F 13/00

[52] U.S. Cl. ..... 362/366; 248/214; 248/323; 248/343

[58] Field of Search ..... 362/365, 366, 285; 248/343, 323, 214

[56] References Cited

U.S. PATENT DOCUMENTS

| | | | |
|---|---|---|---|
| 3,597,889 | 8/1971 | Nigro | 248/343 |
| 4,041,657 | 8/1977 | Schuplin | 248/343 |
| 4,086,480 | 4/1978 | Lahm | 248/343 |
| 4,114,327 | 9/1978 | Williams | 248/343 |
| 4,122,762 | 10/1978 | Williams | 248/343 |
| 4,230,900 | 10/1980 | Speet | 248/343 |
| 4,408,262 | 10/1983 | Kusmer | 362/365 |
| 4,646,212 | 2/1987 | Florence | 362/365 |

*Primary Examiner*—Carroll B. Dority

*Attorney, Agent, or Firm*—Hopgood, Calimafde, Kalil, Blaustein & Judlowe

[57] ABSTRACT

A self locking mounting bar having a notch near one end, which notch fits onto the upper edge of a main runner of a suspended ceiling. The other end of the bar slides into one end of a lighting fixture frame. The bars are generally used in pairs to provide an adjustable mounting apparatus for recessed lighting fixtures; a pair of bars mounted at the same end of the fixture frame, but on opposite sides thereof, may slide toward or away from each other to accomodate variable ceiling runner spacings. Preferably, two pairs of self locking adjustable mounting bars are used to mount a fixture, one pair at each end of the fixture frame. The bar is mounted by placing the notched portion of the bar onto the upper edge of a ceiling runner. The bar then may be locked in place by bending a tab at the end thereof underneath the upper edge of the runner.

12 Claims, 2 Drawing Sheets

SELF LOCKING ADJUSTABLE MOUNTING BARS

BACKGROUND OF THE INVENTION

The invention relates to the field of mounting light fixtures in ceilings. More particularly, it relates to an apparatus and a method for installing a recessed lighting fixture in a ceiling.

Recessed lighting fixtures have become increasingly popular in recent years due to their aesthetic appeal and other advantages. Such fixtures traditionally are mounted in the ceiling so that all the wiring and hardware are hidden from view from below. These fixtures are typically mounted between ceiling joists and just above the level of the finished ceiling surface.

Recessed lighting may be installed in a dropped or suspended ceiling by attaching a fixture frame to the main runners of the ceiling. There are various methods for mounting a fixture to a suspended ceiling. The most common methods use ceiling-mounted mounting bars to support the frame. One well-known method is to use wire to tie the bars to the runners. Other methods employ clips for fastening the bars to the runners. A common attribute of all these methods is that a separate fastening device is required to mount the bars on the runners. This attribute makes the mounting operation more complex, time-consuming, and expensive.

SUMMARY OF THE INVENTION

The apparatus of the present invention comprises a self locking, L-shaped mounting bar having a notch near one end, which notch is adapted to receive the upper portion of a ceiling runner. The other end of the bar may be slidably mounted to one end of a fixture frame. The bars may be used in pairs to provide an adjustable mounting apparatus; a pair of bars mounted at the same end of the fixture frame, but on opposite sides thereof, may slide toward or away from each other to accommodate variable ceiling runner spacings. Preferably, two pairs of self locking adjustable mounting bars are used, one pair at each end of the fixture frame.

The mounting method of this invention comprises positioning a notched mounting bar so that the notch is directly above the upper edge of a ceiling runner, and pushing or dropping the bar onto the runner. The bar then may be locked in place by bending a tab at the end thereof underneath the upper edge of the runner.

It is an object of the present invention to provide self locking, L-shaped adjustable mounting bars for installing recessed lighting fixtures.

It is also an object of the present invention to provide a mounting bar which may be affixed to a ceiling runner without using any additional part or fastening means.

Another object of this invention is to provide an inexpensive, versatile means for mounting recessed lighting fixtures.

A further object of this invention is to provide a simple, quick, and efficient method for mounting recessed lighting fixtures.

Other objects and advantages of the present invention will be apparent to those skilled in the art from the following detailed description and from the appended claims and drawings.

DETAILED DESCRIPTION OF THE PREFERRED EMBODIMENTS

Figure 1:
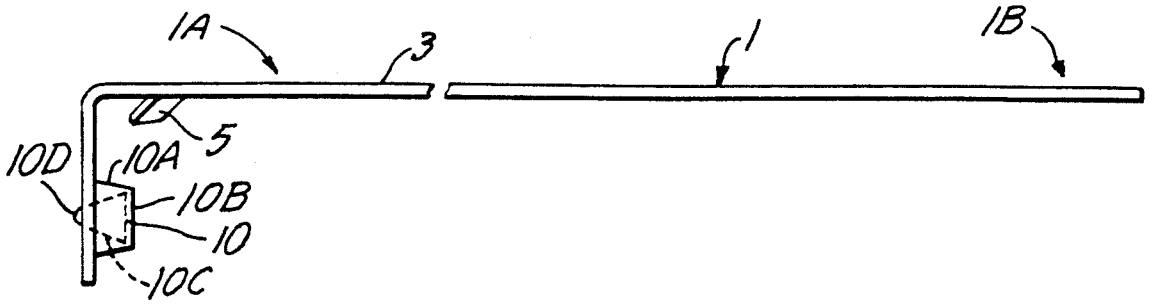
FIG. 1 is a top plan view of a self locking, L-shaped adjustable mounting bar according to the present invention.
Figure 2:
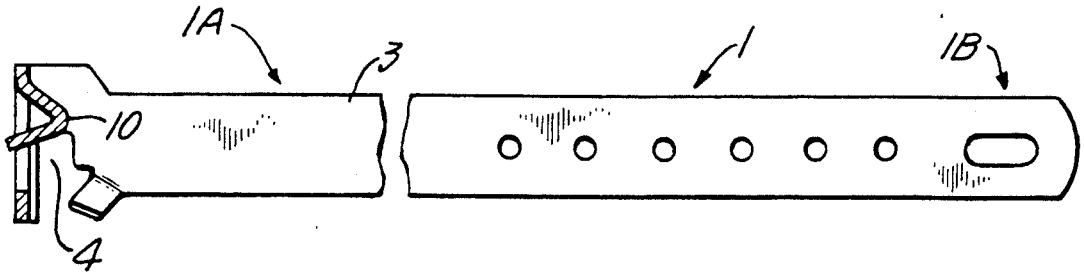
FIG. 2 is a side elevation of the bar shown in FIG. 1.

FIGS. 1–2 illustrate one embodiment of a self locking, L-shaped adjustable mounting bar 1 of the present invention. As shown in FIGS. 1 and 2, main bar section 3 has first and second end portions 1A and 1B, respectively. As shown, first end portion 1A has been bent at a right angle (i.e., orthogonally) to the main bar to form end section 2. A notch 4 and a locking tab 5 are located near the end section 2.

Figure 4:
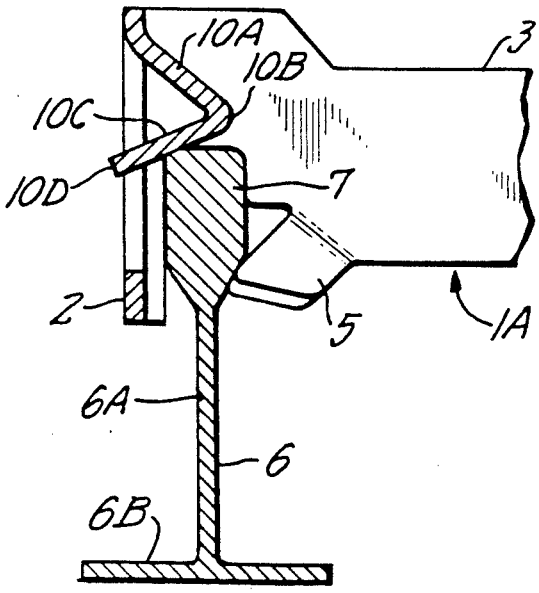
FIG. 4 is a side elevation of a mounting bar locked onto a ceiling runner viewed along line 4—4 of FIG. 3.
Figure 3:
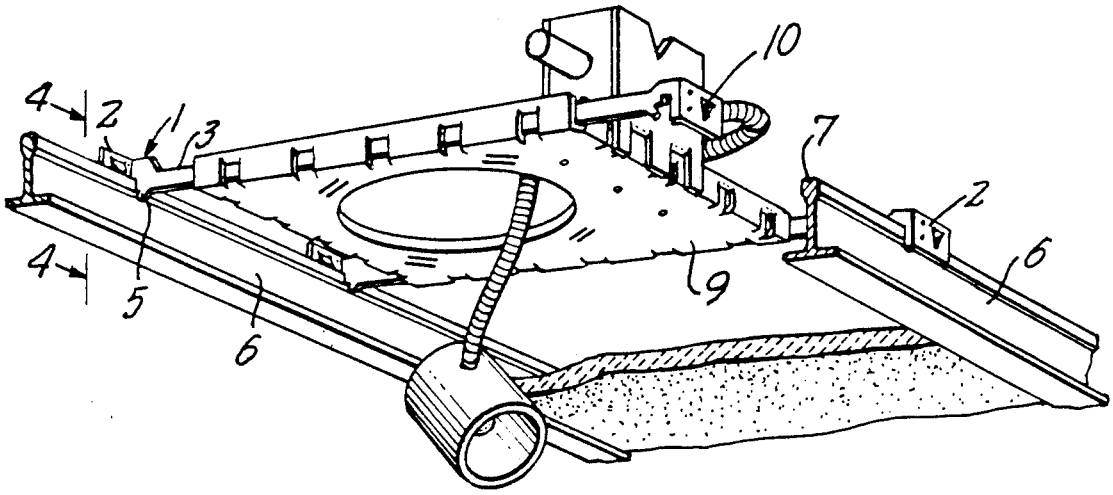
FIG. 3 is a perspective view from below of bars according to the invention utilized in mounting a lighting fixture frame onto suspended ceiling runners.

FIGS. 3–4 illustrate how the bar 1 is mounted onto a suspended ceiling's main runner 6. As shown in FIGS. 3 and 4, main runner 6 comprises an upstanding leg 6A with an upper edge 7 extending along the length of the main runner, and also a bottom leg 6B which is joined to upstanding leg 6A in a substantially perpendicular manner as shown. The cross-section of the runner 6 is generally in the shape of an inverted T, with a thickened portion or bead 7 at the upper edge thereof. The notch 4 is lowered onto the bead 7 to hold the bar 1 securely onto the runner 6. As shown in FIGS. 1, 2 and 4, projection 10 having a V-shaped cross section includes an upper leg portion 10A which extends downwardly from end bar section 2 and continues at apex 10B into bottom leg portion 10C extending inwardly toward end bar section 2 and through an aperture 11 therein, so that pointed tip portion 10D extends slightly therebeyond as shown. As shown in FIG. 4, when notch 4 is lowered onto the upper edge 7 of main runner 6, upper edge 7 engages the bottom face of projection 10, helping to balance bar 1 along the length of the upper edge of the ceiling runner. The tab 5 may be bent under the bead 7 to lock the bar 1 in place. For additional security, one may drive a screw through the end section 2 so that the end of the screw will abut the runner 6 directly underneath the bead 7.

Figure 5:
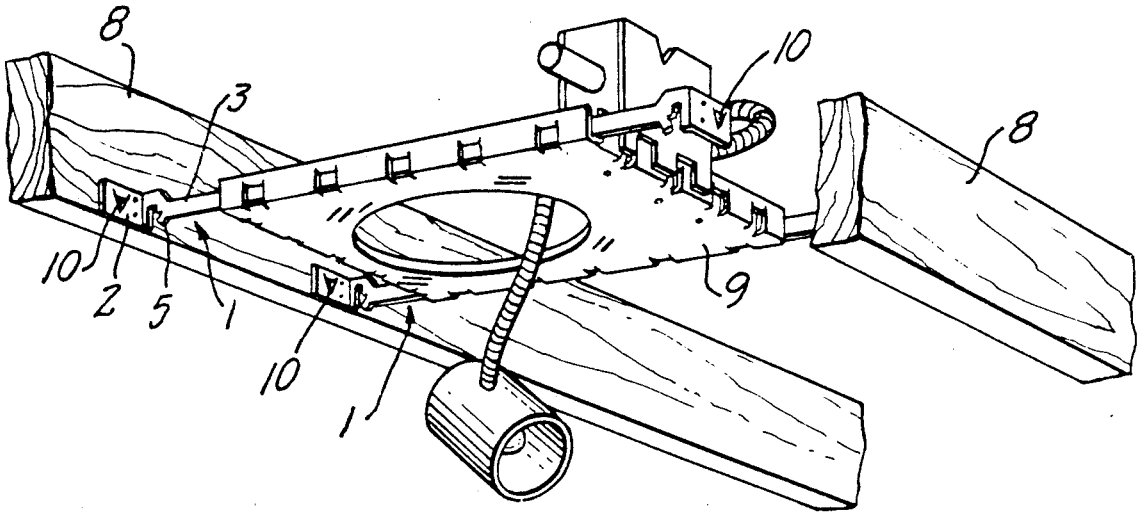
FIG. 5 is a perspective view from below of bars according to the invention utilized in mounting a lighting fixture frame onto ceiling joists.

FIG. 5 illustrates the use of the bar 1 for mounting recessed lighting fixture frames 9 between the joists 8 of a ceiling. When the bar 1 is used in this manner, the notch 4 does not come into play. Instead, the end section 2 is nailed or otherwise fastened to the joist 8.

As shown in FIGS. 4–5, the mounting of a fixture frame 9 in a ceiling generally requires two pairs of bars 1. A pair of bars 1 is slidably mounted at each end of the frame 9, with one bar 1 on each side thereof, so that the bars 1 may slide toward and away from each other to adjust for the spacing of the runners 6 or joists 8 in the ceiling.

The bars of this invention may be constructed of any material which provides the necessary structural support, e.g., metals, alloys, composites, or plastics. Preferably, the bars are steel or aluminum.

The present invention has many advantages. The bars may be made at low cost, and are easy to install. Furthermore, no additional parts are needed when mounting a recessed lighting fixture frame in a suspended ceiling. The bars are versatile enough to fit virtually any ceiling. These and other advantages will be apparent to those skilled in the art from the above description and from the accompanying drawings.

Many variations of this invention are possible without deviating from the spirit of the invention. The invention is not limited to the embodiments described and illustrated, but includes all embodiments consistent with this disclosure and within the scope of the appended claims.

What is claimed:

1. An L-shaped mounting bar for mounting a lighting fixture in a ceiling, said L-shaped mounting bar being adapted for attachment to an inverted T-shaped ceiling runner having an upstanding leg with an upper edge extending along the length of said inverted T-shaped ceiling runner, said L-shaped mounting bar comprising:

a main bar section having first and second end portions, said first end portion further having a notch adapted to receive said upper edge of said inverted T-shaped ceiling runner;

an end bar section orthogonally projecting from said first end portion of said main bar section; and a tab projecting from said first end portion of said main bar section, adjacent said notch, and capable of being bent toward said notch so as to engage a portion of said upstanding leg of said inverted T-shaped ceiling runner.

2. The L-shaped mounting bar of claim 1, which further comprises a projection which extends from said end bar section and is adapted to engage a portion of said upper edge of said upstanding leg of said inverted T-shaped ceiling runner.

3. The L-shaped mounting bar of claim 2 wherein said projection comprises a leg portion which extends inwardly toward said end bar section and terminates through and beyond an aperture formed in said end bar section.

4. An L-shaped mounting bar for mounting a lighting fixture in a ceiling, said L-shaped mounting bar adapted for attachment to a ceiling joist, said L-shaped mounting bar comprising:

a main bar section having first and second end portions;

an end bar section orthogonally projecting from said first end portion of said main bar section; and said end bar section including a projection having a portion which extends inwardly toward said end bar section and terminates through and beyond an aperture formed in said end bar section.

5. A lighting fixture mounting apparatus comprising at least one of L-shaped mounting bars for mounting a lighting fixture in a ceiling, each said L-shaped mounting bar being adapted for attachment to an inverted T-shaped ceiling runner having an upstanding leg with an upper edge extending along the length of said inverted T-shaped ceiling runner, each said L-shaped mounting bar comprising:

a main bar section having first and second end portions, said first end portion further having a notch adapted to receive said upper edge of said inverted T-shaped ceiling runner;

an end bar section orthogonally projecting from said first end portion of said main bar section; and one or more fastening means disposed on said second end portion of said main bar section, and said second end portion being capable of attachment to a selected portion of a lighting fixture frame so that each said end bar section of said pair of L-shaped mounting bars extends between a pair of said spaced apart inverted T-shaped ceiling runners.

6. The lighting fixture mounting apparatus of claim 5, which further comprises two pairs of said L-shaped mounting bars.

7. A lighting fixture mounting apparatus comprising at least one pair of L-shaped mounting bars for mounting a lighting fixture in a ceiling, each said L-shaped mounting bar being adapted for attachment to an inverted T-shaped ceiling runner having an upstanding leg with an upper edge extending along the length of said inverted T-shaped ceiling runner, each said L-shaped mounting bar comprising:

a main bar section having first and second end portions, said first end portion further having a notch adapted to receive said upper edge of said inverted T-shaped ceiling runner;

an end bar section orthogonally projecting from said first end portion of said main bar section;

a tab projecting from said first end portion of said main bar section, adjacent said notch, and capable of being bent toward said notch so as to engage a portion of said upstanding leg of said inverted T-shaped ceiling runner; and one or more fastening means disposed on said second end portion of said main bar section, and said second end portion being capable of attachment to a selected portion of a lighting fixture frame so that each said end bar section of said pair of L-shaped mounting bars extends between a pair of said spaced apart inverted T-shaped ceiling runners.

8. The lighting fixture mounting apparatus of claim 7, which further comprises two pairs of said L-shaped mounting bars.

9. A lighting fixture mounting apparatus comprising at least one pair of L-shaped mounting bars, each said L-shaped mounting bar adapted for attachment to a ceiling joist, said L-shaped mounting bar comprising:

a main bar section having first and second end portions;

an end bar section orthogonally projecting from said first end portion of said main bar section; said end bar section including a projection having a portion which extends inwardly toward said end bar section and terminates through and beyond an aperture formed in said end bar section; and one or more fastening means disposed on said second end portion of said main bar section and said second end portion being capable of attachment to a selected portion of a lighting frame fixture so that each said end bar section of said pair of L-shaped mounting bars extends between a pair of said spaced apart inverted T-shaped ceiling runners.

10. The lighting fixture mounting apparatus of claim 9, which further comprises two pairs of said L-shaped mounting bars.

11. A method for mounting a lighting fixture in a ceiling comprising:

positioning an L-shaped mounting bar, said L-shaped mounting bar comprising a main bar section having first and second end portions, said first end portion further having a notch adapted to receive the upper edge of the upstanding leg of an inverted T-shaped ceiling runner, an end bar section orthogonally projecting from said first end portion of said main bar section, and a tab projecting from said first end portion of said main bar section, adjacent said notch, and capable of being bent toward said notch so as to engage a portion of said upstanding leg of said inverted T-shaped ceiling runner, so that said notch of said first end portion is directly above the upper edge of said ceiling runner; and subsequently lowering said L-shaped mounting bar onto said inverted T-shaped ceiling runner so that said upper edge of said inverted T-shaped ceiling runner engages the notch of said first end portion of said L-shaped mounting bar.

12. The method for mounting a recessed lighting fixture of claim 6, further comprising bending said tab toward said notch of said first end section subsequent to lowering said L-shaped mounting bar onto said inverted T-shaped ceiling runner, until said tab engages said upper edge of said upstanding leg of said inverted T-shaped ceiling runner.

* * * * *

UNITED STATES PATENT AND TRADEMARK OFFICE

CERTIFICATE OF CORRECTION

PATENT NO. : 5,045,985

DATED : September 3, 1991

INVENTOR(S) : Neil Russo and Kingsley Chan

It is certified that error appears in the above—identified patent and that said Letters Patent is hereby corrected as shown below:

Column 3, line 56 in Claim 5 after "at least one," insert: --pair--.

Signed and Sealed this

Fifth Day of January, 1993

*Attest:*

DOUGLAS B. COMER

*Attesting Officer*

*Acting Commissioner of Patents and Trademarks*